US011175088B2

(12) United States Patent
Guelmez et al.

(10) Patent No.: US 11,175,088 B2
(45) Date of Patent: Nov. 16, 2021

(54) COOLING DEVICE WITH AN AIR GUIDING ELEMENT

(71) Applicant: BSH HAUSGERAETE GMBH, Munich (DE)

(72) Inventors: Muemin Guelmez, Istanbul (TR); Guercan Oral, Tekirdag (TR); Erdem Suemer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 30 days.

(21) Appl. No.: 16/026,677

(22) Filed: Jul. 3, 2018

(65) Prior Publication Data

US 2019/0078828 A1 Mar. 14, 2019

(30) Foreign Application Priority Data

Sep. 10, 2017 (TR) ..... 2017/13310

(51) Int. Cl.
*F25D 21/04* (2006.01)
*F25D 23/02* (2006.01)
*F25D 23/00* (2006.01)

(52) U.S. Cl.
CPC ..... *F25D 21/04* (2013.01); *F25D 23/028* (2013.01); *F25D 23/003* (2013.01); *F25D 2323/00274* (2013.01); *F25D 2323/02* (2013.01)

(58) Field of Classification Search
CPC ..... F25D 21/04; F25D 21/06; F25D 21/12; F25D 21/125; F25D 23/02; F25D 23/023; F25D 23/028; F25D 2323/00274; F25D 2323/02; A47F 3/043
See application file for complete search history.

(56) References Cited

U.S. PATENT DOCUMENTS 1,847,109 A * 3/1932 Holbrook ..... F25D 21/04 62/277
2,675,901 A * 4/1954 Childers ..... G07F 9/105 194/350
3,006,708 A * 10/1961 Saunders ..... F25D 23/028 312/406.2
3,025,681 A * 3/1962 Booth ..... A47F 3/043 62/248
3,078,134 A * 2/1963 Haynes, Jr. ..... F25D 23/082 312/296
3,307,373 A * 3/1967 Booth ..... A47F 3/043 62/248
3,462,966 A * 8/1969 Reid ..... F25D 21/04 62/248

(Continued)

FOREIGN PATENT DOCUMENTS

JP 2007024348 A * 2/2007

*Primary Examiner* — Jianying C Atkisson
*Assistant Examiner* — Miguel A Diaz
(74) *Attorney, Agent, or Firm* — Laurence A. Greenberg; Werner H. Stemer; Ralph E. Locher

(57) ABSTRACT

A cooling device, particularly a household refrigerator, has a housing defining a storage space. A door assembly attached to the housing enables access to the storage space. A unit that emits heat to its surrounding is disposed on the cooling device. The heated air around the unit is discharged through an air outlet. An air guiding element directs the discharged air upwardly so as to flow along the door assembly. The air guiding element is provided on the door assembly.

16 Claims, 4 Drawing Sheets

(56) References Cited

U.S. PATENT DOCUMENTS 4,009,586 A * 3/1977 Skvarenina ..... F25D 21/04 62/80
4,325,227 A * 4/1982 Ibrahim ..... A47F 3/0408 62/248
4,347,710 A * 9/1982 Ibrahim ..... F25D 21/125 62/155
4,478,047 A * 10/1984 Ibrahim ..... F25D 21/125 62/248
4,977,754 A * 12/1990 Upton ..... A47F 3/0408 221/150 R
5,606,863 A * 3/1997 Kicklighter ..... A47F 3/0413 62/248
6,151,904 A * 11/2000 Jin ..... A47F 3/0434 454/198
8,104,302 B2 * 1/2012 Hayase ..... A47F 3/0426 62/246
8,215,921 B2 * 7/2012 Coonrod ..... A47F 3/0434 417/45
8,429,923 B2 * 4/2013 Iguchi ..... A47F 3/0426 62/248
9,829,240 B2 * 11/2017 Staedel ..... F25D 23/028
2005/0178139 A1 * 8/2005 Kim ..... F25D 21/04 62/277
2008/0122324 A1 * 5/2008 Bienick ..... E05D 7/1011 312/116
2010/0199686 A1 * 8/2010 Taras ..... H05B 3/84 62/3.4
2013/0098075 A1 * 4/2013 Hegedus ..... F25D 21/08 62/80
2015/0013375 A1 * 1/2015 Staedel ..... F25D 23/028 62/407
2016/0320119 A1 * 11/2016 Ertik ..... E05F 15/71
2017/0150827 A1 * 6/2017 Choueifati ..... A47F 3/0482
2017/0280897 A1 * 10/2017 Sparks ..... A47F 3/0482
2018/0017306 A1 * 1/2018 Miller ..... F25C 1/147
2018/0149408 A1 * 5/2018 Akca ..... E05B 17/0033
2019/0049169 A1 * 2/2019 Ciyanoglu ..... F25D 25/025
2019/0078828 A1 * 3/2019 Guelmez ..... F25D 23/028
2019/0218029 A1 * 7/2019 Petz ..... B65F 1/14
2020/0041196 A1 * 2/2020 Heckler ..... E05C 19/161
2020/0064050 A1 * 2/2020 Desphande ..... A47F 3/0426

* cited by examiner

COOLING DEVICE WITH AN AIR GUIDING ELEMENT

CROSS-REFERENCE TO RELATED APPLICATION

This application claims the priority, under 35 U.S.C. § 119, of Turkish application TR 2017/13310, filed Sep. 10, 2017; the prior application is herewith incorporated by reference in its entirety.

BACKGROUND OF THE INVENTION

Field of the Invention

The present invention relates to a cooling device, particularly a household refrigerator, comprising an air guiding element that prevents condensation which may occur on the outer surface of the door assembly of the cooling device.

In cooling systems, temperatures of the outer surfaces of the cooling devices can be below the dew point of the ambient air. Therefore, condensation may occur on the outer surfaces of the cooling devices.

U.S. Pat. No. 4,009,586 discloses a method and apparatus for preventing condensation from forming about refrigerator and freezer doors. Warm air produced by the compressor of a refrigerator or freezer unit is channeled either directly or indirectly therefrom to flow vertically along the peripheral sealed edges of the freezer door to prevent condensation from developing therealong. The heated air from the compressor is directed through a vent or outlet port formed in a kick plate or through outlets formed in the housing at a location near the bottom vertical edges of the door. This will provide vertical columns of warm air to flow therealong and prevent condensation.

The invention provides an additional improvement, an additional advantage or an alternative to the prior art.

BRIEF DESCRIPTION OF THE INVENTION

An object of the invention is to provide a cooling device wherein the condensation that may occur on the outer surface of the door assembly thereof is prevented by means of a simple and low-cost configuration.

In order to achieve the object, the invention is a cooling device, particularly a household refrigerator, comprising a housing defining a storage space, a door assembly attached to the housing for access to the storage space, a unit emitting heat to its surrounding disposed on the cooling device, an air outlet through which the heated air around the unit is discharged, an air guiding element directing the discharged air upwardly so as to flow along the door assembly. The air guiding element is provided on the door assembly. Thus, while the door assembly is in the closed position, the air guiding element directs the discharged air and the discharged warm air increases the temperature of the outer surface of the door assembly. Therefore, condensation that may occur on the outer surface is prevented by using waste heat emitted by the unit during the working of the cooling device. On the other hand, when the door assembly is opened, air guiding element provided on the door assembly is separated from the housing of the cooling device. Hence, the air guiding element cannot direct the discharged air upwardly while the door assembly is in the opened position and so heating of the storage space is prevented.

In this context, the unit could be embodied as any element of the cooling device emits heat. In particular, the unit could be embodied as a condenser or a compressor.

In a possible embodiment of the invention, the air guiding element comprises a curved portion extending so as to direct the discharged air upwardly. Thus, the outer surface of the door assembly is heated and the condensation is prevented.

In a possible embodiment of the invention, the curved portion contacts with bottom of the air outlet when the door assembly is in the closed position. Thus, adequate sealing between the air guiding element and the air outlet is obtained so the heated air discharged through the air outlet can be directed upwardly by means of an air guiding element almost without any leakage.

In a possible embodiment of the invention, the air guiding element comprises a main portion extending vertically parallel to the door assembly. Thus, the air guiding element is easily attached to the door assembly. Moreover, the discharged air can be directed upwardly without any flow separation.

In a possible embodiment of the invention, the air guiding element comprises at least one bracket on the main portion. Thus, the air guiding element is securely attached to the door assembly by means of the bracket. In particular, the bracket is formed at the end of the main portion. Moreover, in a possible embodiment, the bracket comprises a hole through which the air guiding element is screwed to the door assembly.

In a possible embodiment of the invention, the air guiding element comprises at least one ridge on the main portion. Thus, the connection between the air guiding element and the door assembly is supported by means of the ridge.

In a possible embodiment, the ridge extends from the bracket towards the curved portion. Particularly, the ridge narrows from the bracket towards the curved portion. Thus, the ridge provides more equally distributed and linear flow on the door assembly. In a possible embodiment, the ridge and the bracket are manufactured as a single piece.

In a possible embodiment of the invention, the main portion has a wedged end. Thus, the discharged air can be effectively directed to the outer surface where condensation may occur.

In a possible embodiment of the invention, the door assembly comprises a door and a decorative panel connected to an external side of the door and the discharged air is directed through a gap formed between the door and the decorative panel. Thus, the air guiding element can also be used for built-in appliances. The air guiding element directs the discharged air upwardly so as to flow along the outer surface of the door. The discharged air heats the outer surface of the door, the gap and the decorative panel. Hence, it prevents the condensation that may occur on the outer surface of the door and/or the outer surface of the decorative panel. On the other hand, in a possible embodiment, the door assembly may have only a door. Therefore, the discharged air is guided to the outer surface of the door and it heats the outer surface of the door for preventing the condensation that may occur on the outer surface of the door.

In a possible embodiment of the invention, the air guiding element extends from the level of the bottom of the door to level of the bottom of the decorative panel. Thus, the heated air can be directed from where it is discharged to the where the gap is formed.

In a possible embodiment of the invention, the air guiding element is connected to the door. Thus, whether the door assembly comprises a decorative panel, the air guiding element can be attached to the door assembly. In a possible embodiment, the air guiding element is screwed to the door.

In a possible embodiment of the invention, the air guiding element is connected to the bottom of the door by screwing through a hole provided on the bracket. Thus, reliable connection between the door and the air guiding element is obtained.

In another possible embodiment of the invention, the air guiding element may be connected to the decorative panel. In particular, the air guiding element can be adhered to the decorative panel. Thus, the air guiding element is attached to the door assembly in an easy manner.

In a possible embodiment, the wedged end extends towards the gap. Thus, the discharged air easily guided into the gap.

In a possible embodiment of the invention, the cooling device has a machine compartment for at least the unit and having an air inlet through which ambient air is sucked and the air outlet through which the heated air around the unit is discharged. Thus, the machine compartment encloses the unit. The machine compartment is arranged inside the housing and positioned below the storage space. In a possible embodiment, the air inlet and the air outlet are located side by side below the storage space. In particular, the air inlet and the air outlet are located on the front wall of the machine compartment. On the other hand, in an alternative embodiment, the air inlet and the air outlet can be located on the different parts of the cooling device. When it is so, at least one or both side of the air guiding element is closed by a side wall that may be an external side wall or a side wall integrated to the air guiding element.

In a possible embodiment of the invention, a separator is located as remained between the air inlet and the air outlet when the door assembly is in the closed position. Thus, it is prevented that the discharged air is sucked by the air inlet.

The separator is manufactured as a separate element. On the other hand, in a possible embodiment, the separator can be integrally manufactured with the air guiding element.

In a possible embodiment, the air guiding element may have at least one side wall to cover at least one side thereof. For instance, it may have a side wall to cover the side opposite to the side covered by the separator.

In this context, with the indications "top", "bottom", "front", "rear", "horizontal", "vertical", etc. the positions and orientations given for intended use and intended arrangement of the appliance and for a user then standing in front of the appliance and viewing in the direction of the device are indicated.

In this context, "inner surface" defines the surface facing towards the storage space while the door assembly is in the closed position. In this context, "outer surface" of an element defines the surface of the element facing away from the storage space while the door assembly is in the closed position.

BRIEF DESCRIPTION OF THE SEVERAL VIEWS OF THE DRAWING

The figures, whose brief explanations are herewith provided, are solely intended for providing a better understanding of the present invention and are as such not intended to define the scope of protection or the context in which said scope is to be interpreted in the absence of the description.

DETAILED DESCRIPTION OF THE INVENTION

In this detailed description, the subject matter is explained with references to examples without forming any restrictive effect only in order to make the subject more understandable.

Figure 1:
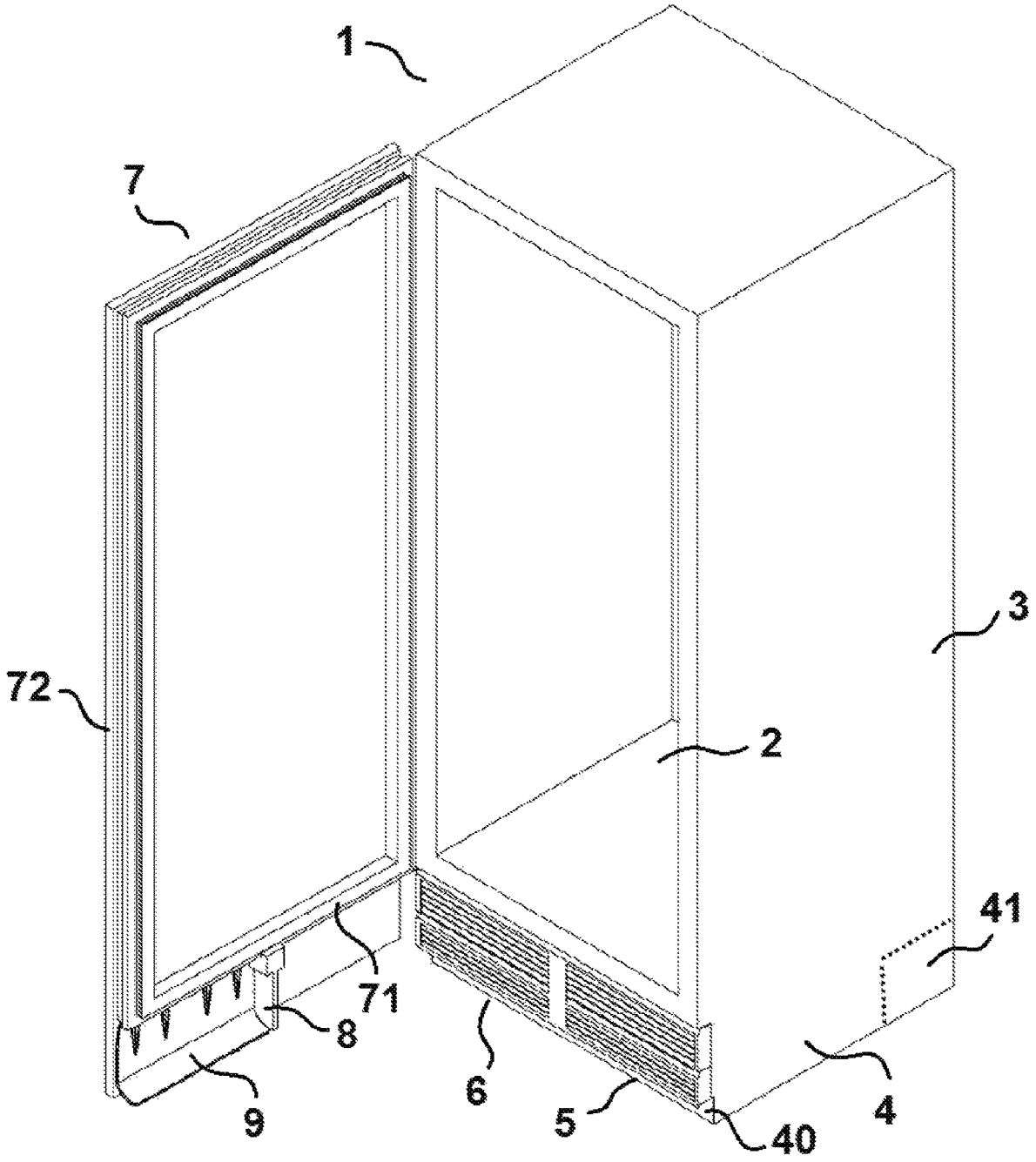
FIG. 1 is a top isometric view of the cooling device of the present invention.

As shown in the FIG. 1, the cooling device (1) is embodied as a household refrigerator. The cooling device (1) comprises a storage space (2) for storing the victuals. The storage space (2) is delimited by a housing (3). The cooling device (1) comprises a door assembly (7) attached to the housing (3) for access to the storage space (2). The door assembly (7) comprises a door (71) and a decorative panel (72) connected to an external side of the door (71). Thus, the decorative panel (72) provides an aesthetical appearance while the door assembly (7) is in the closed position.

The cooling device (1) comprises a machine compartment (4) arranged inside the housing (3) and positioned below the storage space (2). The machine compartment (4) encloses several units of the cooling device (1). The unit (41) shown schematically in the FIG. 1 can be a compressor, a condenser or a component of the refrigerant cycle of the cooling device (1) or any element of the cooling device (1) emitting heat. During the working of the cooling device (1), the unit (41) emits heat to its surrounding and so the air around the unit (41) is heated. The cooling device (1) comprises an air inlet (6) for sucking the ambient air and an air outlet (5) for discharging the heated air around the unit (41) in order to cool the unit (41). The air inlet (6) and the air outlet (5) are located side by side below the storage space (2). Especially, the air inlet (6) and the air outlet (5) are located on the front wall (40) of the machine compartment (4). A separator (8) is arranged on the door assembly (7) in order to seat between the air inlet (6) and air outlet (5) while the door assembly (7) is in the closed position. Thus, the separator (8) prevents the communication between the air inlet (6) and the air outlet (5). The air discharged through the air outlet (5) cannot be sucked by the air inlet (6).

The cooling device (1) comprises an air guiding element (9) in order to guide the discharged air. The air guiding element (9) is attached to the door assembly (7). In particular, the air guiding element (9) is attached to the door (71).

Figure 2:
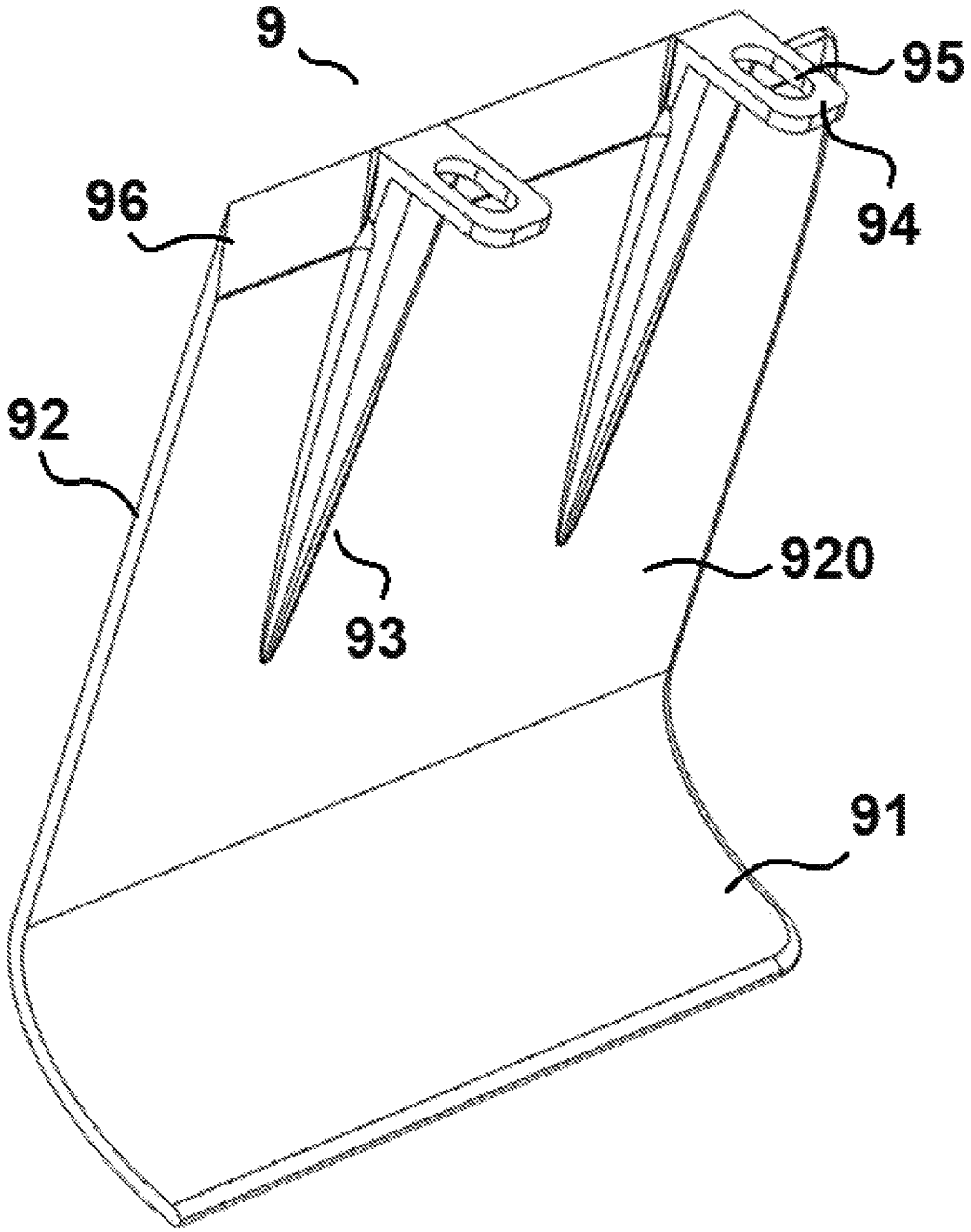
FIG. 2 is an isometric view of the air guiding element.

As shown in the FIG. 1 and FIG. 2, the air guiding element (9) comprises a curved portion (91) and a main portion (92) extending vertically parallel to the door assembly (7) as continuation of the curved portion (91). The air guiding element (9) also comprises a wedged end (96). The air guiding element (9) comprises several ridges (93) on the main portion (92). Especially, the ridges (93) are provided on the inner surface (920) of the main portion (92). The ridges (93) narrow towards the curved portion (91). The ridges (93) extend from the bottom of a bracket (94) towards the curved portion (91). The air guiding element (9) comprises brackets (94) arranged on the main portion (92) in order to mount the air guiding element (9) to the door assembly (7). Especially, the brackets (94) are provided at the end of the main portion (92). Each bracket (94) comprises a hole (95) for a screw, for example, to mount the air guiding element (9) to the door assembly (7).

Figure 3:
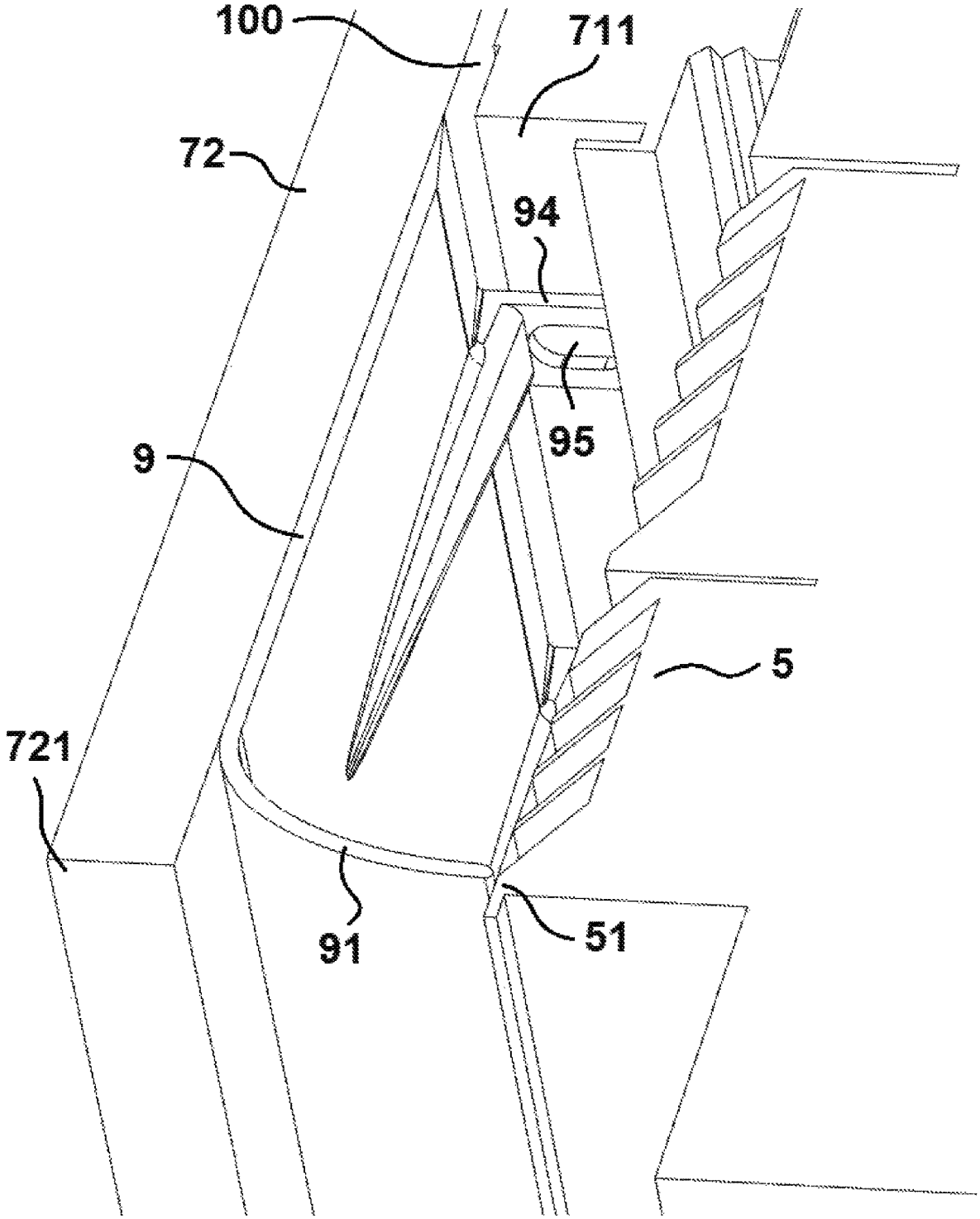
FIG. 3 is a bottom isometric view of the cooling device of the present invention.

As shown in the FIG. 3, the air guiding element (9) is connected to the bottom (711) of the door (71) by screwing through the hole (95) of the bracket (94). The bracket (94) extends horizontally from the wedged end (96) towards the door (71). The air guiding element (9) extends from the level of the bottom (711) of the door (71) to level of the bottom (721) of the decorative panel (72). The curved portion (91) contacts with bottom (51) of the air outlet (5). A gap (100) is formed between the decorative panel (72) and the door (71) along the door (71).

Figure 4:
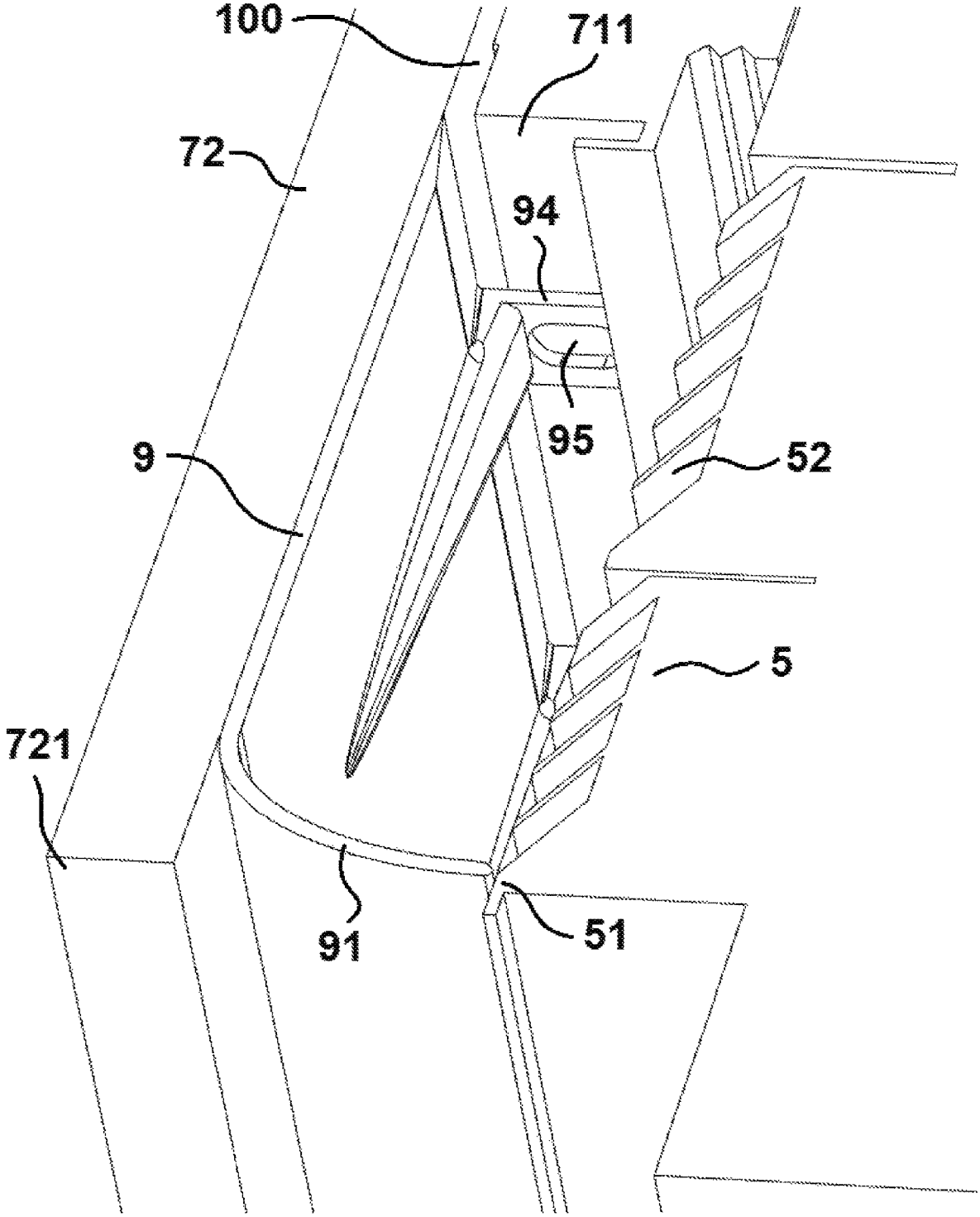
FIG. 4 is a cross-sectional view of the cooling device of the present invention.

Cross-sectional view of the cooling device (1) is shown in the FIG. 4 while the door assembly (7) is in the closed position. In this position, the discharged air is directed upwardly so as to flow along the door assembly (7) by means of the air guiding element (9), especially by means of the curved portion (91). The ridges (93) assist the equal distribution of the discharged air flow and enhance the linear flow of the discharged air. The wedged end (96) extends towards the gap (100) in order to ease the entry of the discharged air into the gap (100). The discharged air is transmitted through the gap (100) to the outer surface of the door (71). Thus, the discharged air heats both the outer surface of the door (71) and the inner surface of the decorative panel (72) and thereby temperature of the outer surface of the door (71) and/or the decorative panel (72) does not decrease below the dew point of the ambient air and the condensation is prevented. The discharged air exists from the top of the door (71) thanks to the chimney effect.

On the other hand, while the door assembly (7) is in the opened position, the air is discharged to the ambient as directed away from the storage space (2) due to inclined fins (52) of the air outlet (5) so it is prevented that discharged air increases the temperature of the storage space (2).

The following is a summary list of reference numerals and the corresponding structure used in the above description of the invention:

1 Cooling Device
2 Storage Space
3 Housing
4 Machine Compartment
40 Front Wall of the Machine Compartment
41 Unit
5 Air Outlet
51 Bottom of the Air Outlet
52 Fin
6 Air Inlet
7 Door Assembly
71 Door
711 Bottom of the Door
72 Decorative Panel
721 Bottom of the Decorative Panel
8 Separator
9 Air Guiding Element
91 Curved Portion
92 Main Portion
920 Inner Surface of the Main Portion
93 Ridge
94 Bracket
95 Hole of the Bracket
96 Wedged End
100 Gap

The invention claimed is:

1. A cooling device, comprising a housing defining a storage space;

a door assembly pivotally attached to said housing for pivoting between a closed position and an open position for access to said storage space;

a unit emitting heat to a surrounding disposed on the cooling device;

an air outlet through which the heated air is discharged from around said unit;

an air guide mounted to said door assembly and pivotable together with said door assembly into the open position, and, when said door assembly is in the closed position, said air guide being disposed to direct the air discharged from around said unit upwardly so as to flow along said door assembly;

wherein said air guide is formed with a curved portion extending so as to direct the discharged air upwardly, and said curved portion contacts a bottom of said air outlet when said door assembly is in the closed position.

2. The cooling device according to claim 1, which comprises a machine compartment for accommodating said unit and having an air inlet through which ambient air is aspirated and an air outlet through which heated air is discharged from around said unit.

3. The cooling device according to claim 1 configured as a household refrigerator.

4. The cooling device according to claim 1, wherein said air guide comprises a main portion extending vertically, parallel to said door assembly.

5. The cooling device according to claim 4, wherein said air guide includes at least one bracket disposed on said main portion.

6. The cooling device according to claim 4, wherein said main portion has a wedged end.

7. The cooling device according to claim 1, wherein said door assembly comprises a door and a decorative panel on an exterior side of said door, and wherein the air discharged from said unit is directed through a gap formed between said door and said decorative panel.

8. The cooling device according to claim 7, wherein said air guide extends from a level defined by a bottom of said door to a level defined by a bottom of said decorative panel.

9. The cooling device according to claim 7, wherein the air guide is fixedly connected to said door.

10. The cooling device according to claim 7, wherein said air guide has a main portion formed with a wedged end extending towards said gap.

11. A cooling device, comprising:

a housing defining a storage space;

a door assembly pivotally attached to said housing for pivoting between a closed position and an open position for access to said storage space;

a unit emitting heat to a surrounding disposed on the cooling device;

an air outlet through which the heated air is discharged from around said unit;

an air guide mounted to said door assembly and pivotable together with said door assembly into the open position, and, when said door assembly is in the closed position;

wherein said air guide is disposed to direct the air discharged from around said unit upwardly so as to flow along said door assembly;

wherein said air guide includes a main portion extending vertically, parallel to said door assembly; and said air guide includes at least one ridge disposed on said main portion.

12. The cooling device according to the claim 11, wherein said air guide is formed with a curved portion extending so as to direct the discharged air upwardly.

13. The cooling device according to the claim 12, wherein said curved portion contacts a bottom of said air outlet when said door assembly is in the closed position.

14. A cooling device, comprising:

a housing defining a storage space;

a door assembly pivotally attached to said housing for pivoting between a closed position and an open position for access to said storage space;

a unit emitting heat to a surrounding disposed on the cooling device;

an air outlet through which the heated air is discharged from around said unit;

an air guide mounted to said door assembly and pivotable together with said door assembly into the open position, and, when said door assembly is in the closed position, said air guide being disposed to direct the air discharged from around said unit upwardly so as to flow along said door assembly;

wherein said air guide includes a main portion extending vertically, parallel to said door assembly; and wherein said air guide includes at least one bracket and at least one ridge on said main portion, said ridge extending from said bracket towards a curved portion.

15. A cooling device, comprising a housing defining a storage space;

a door assembly pivotally attached to said housing for pivoting between a closed position and an open position for access to said storage space;

a unit emitting heat to a surrounding disposed on the cooling device;

an air outlet through which the heated air is discharged from around said unit;

an air guide mounted to said door assembly and pivotable together with said door assembly into the open position, and, when said door assembly is in the closed position, said air guide being disposed to direct the air discharged from around said unit upwardly so as to flow along said door assembly; and wherein said door assembly has a door and a decorative panel on an exterior side of said door, and wherein the air discharged from said unit is directed through a gap formed between said door and said decorative panel; and wherein said air guide is fixedly connected to the bottom of said door by screwing through a hole formed in a bracket disposed on said air guide.

16. A cooling device, comprising a housing defining a storage space;

a door assembly pivotally attached to said housing for pivoting between a closed position and an open position for access to said storage space;

a unit emitting heat to a surrounding disposed on the cooling device;

an air outlet through which the heated air is discharged from around said unit;

an air guide mounted to said door assembly and pivotable together with said door assembly into the open position, and, when said door assembly is in the closed position, said air guide being disposed to direct the air discharged from around said unit upwardly so as to flow along said door assembly;

a machine compartment for accommodating said unit and having an air inlet through which ambient air is aspirated and an air outlet through which heated air is discharged from around said unit; and a separator disposed to remain between said air inlet and said air outlet when said door assembly is in the closed position.

* * * * *